US007260907B2

(12) United States Patent
Sturba et al.

(10) Patent No.: US 7,260,907 B2
(45) Date of Patent: Aug. 28, 2007

(54) PRINTABLE DIE CUT BUSINESS CARD HOLDER

(76) Inventors: Michael A. Sturba, 1911 Francois Road, Windsor, Ontario (CA) N8W 4S9; Russell N. Wilson, 1858 Labadie, Windsor, Ontario (CA) N8W 4J7

( * ) Notice: Subject to any disclaimer, the term of this patent is extended or adjusted under 35 U.S.C. 154(b) by 242 days.

(21) Appl. No.: 10/723,635

(22) Filed: Nov. 26, 2003

(65) Prior Publication Data

US 2004/0099541 A1 May 27, 2004

Related U.S. Application Data

(60) Provisional application No. 60/430,246, filed on Dec. 2, 2002.

(51) Int. Cl.
*G09F 1/08* (2006.01)

(52) U.S. Cl. ..... 40/539; 206/45.26; 248/459

(58) Field of Classification Search ..... 40/661.08, 40/122, 120, 539, 661.01; 248/459, 174, 248/460; 206/39, 449
See application file for complete search history.

(56) References Cited

U.S. PATENT DOCUMENTS 1,563,687 A * 12/1925 Chaney ..... 248/459
2,515,887 A * 7/1950 Moore ..... 206/45.26
2,755,582 A * 7/1956 Nichols ..... 40/121
4,084,015 A * 4/1978 Patterson ..... 428/9
4,579,232 A * 4/1986 Fedak ..... 211/50
4,817,905 A 4/1989 Rondone
4,819,792 A * 4/1989 Christian ..... 206/45.25
4,965,946 A 10/1990 Hegedus et al.
5,458,242 A 10/1995 Baka et al.
5,573,110 A 11/1996 Nguyen
5,950,341 A 9/1999 Cross
5,993,928 A 11/1999 Popat
5,996,130 A 12/1999 Verhines
6,220,555 B1 4/2001 Chase
6,294,237 B1 9/2001 Popat
6,631,839 B2 10/2003 Shair
2002/0158116 A1 10/2002 Shair

* cited by examiner

*Primary Examiner*—Cassandra Davis
(74) *Attorney, Agent, or Firm*—Fraser Clemens Martin & Miller LLC; William J. Clemens

(57) ABSTRACT

A printable die cut business card holder includes a holder blank formed in a sheet of stock adapted processed through a printer for affixing designs, logo, messages and the like. The blank is separated from a carrier portion of the sheet at a die cut line and folded to form the business card holder. The blank includes a front portion, a rear portion, a connector portion and a holder portion attached at score lines. Wings, sides and tabs cooperate to form a holder pocket for receiving business cards. A pair of support supports fold outwardly from the rear portion to stand the holder upright on a horizontal surface.

15 Claims, 3 Drawing Sheets

PRINTABLE DIE CUT BUSINESS CARD HOLDER

CROSS-REFERENCE TO RELATED APPLICATION

This application claims the benefit of U.S. Provisional Patent Application Ser. No. 60/430,246 filed Dec. 2, 2002.

BACKGROUND OF THE INVENTION

The present invention relates generally to printable paper products and, in particular, to a printable die cut business card holder.

Personal business cards remain a viable means of advertising in today's business environment. The combination of typical information displayed and portability render the business card a valuable tool in promoting goods and services to the recipient without being overbearing or overly obtrusive.

Various means of presenting and making business cards available are known in the art, many of which are permanent and expensive to produce. Various types of business card stock and address labels are known that are sized to be run through and printed on a commercially available printer.

The U.S. Pat. No. 4,817,905 discloses a foldable stand-up support device that is constructed of a single sheet of cardboard and includes an integrally attached box for displaying and dispensing items, and legs for supporting the device on a flat surface.

The U.S. Pat. No. 5,458,242 discloses a free-standing collapsible literature holder that is die cut from an elongated sheet and includes a flap that is folded in to expose an opening for displaying and dispensing items, such as pamphlets and the like.

The U.S. Pat. No. 5,950,341 discloses a display device and easel that is formed from a single piece of die cut paperboard and includes a plurality of slots on a rear panel for receiving a tabs on a front panel to form an aperture for receiving a photograph. The device also includes extendable legs on a middle panel for displaying the device on a flat surface.

The U.S. Pat. No. 6,294,237 discloses a free form laminated cardstock assembly that includes a sheet of card stock able to be printed on a printer and having a plurality of die cuts for creating a laminated object, such as throwing toys or a napkin ring, after printing.

The U.S. Pat. No. 6,631,839 discloses a holder for business cards that is formed from a single piece of die cut cardboard or the same stock as used for business cards. When assembled, the holder includes a display area on a front portion thereof for customizing the appearance of the holder.

It is desirable, therefore, to provide a business card holder that is able to be run through a commercially available printer to provide a business card holder that is portable and inexpensive to produce.

SUMMARY OF THE INVENTION

The present invention concerns a printable die cut business card holder. The card holder includes a sheet of stock adapted to be run through a printer. A blank is formed in the sheet of stock, an outer edge of which is defined by a plurality of die cut lines. The blank also includes a plurality of score lines intermediate the die cut lines. The blank can be printed by processing the sheet of stock through the printer. The blank can be separated from the sheet of stock along the die cut lines and folded along the score lines to form a business card holder having a front portion, a rear portion, and a holder portion.

The business card holder in accordance with the present invention is able to be run through a commercially available printer and provides a business card holder that is portable and inexpensive to produce.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Referring now to FIGS. 1-7, a blank 12 for use as a printable die cut business card holder in accordance with the present invention is shown. The blank 12 is formed from a sheet of paper stock 10 of the type used for forming business cards, business card holders and counter displays, or a similar type heavy paper stock. Preferably, the sheet 10 is sized to a standard paper sheet size, such as 8½ inch by 11 inch paper, 8½ inch by 14 inch paper, A4 paper, and the like, and that can be used with a suitable printer (not shown), such as a commercially available black and white printer or a color printer. For example, the blank 12 in a single sheet form is particularly suited to the types of commercially available printers used with personal computers in homes and businesses. Alternatively, the sheet 10 can be sized to reduce the amount of waste material at the edges and/or can be provided in continuous feed form for high speed volume printing.

Figure 1:
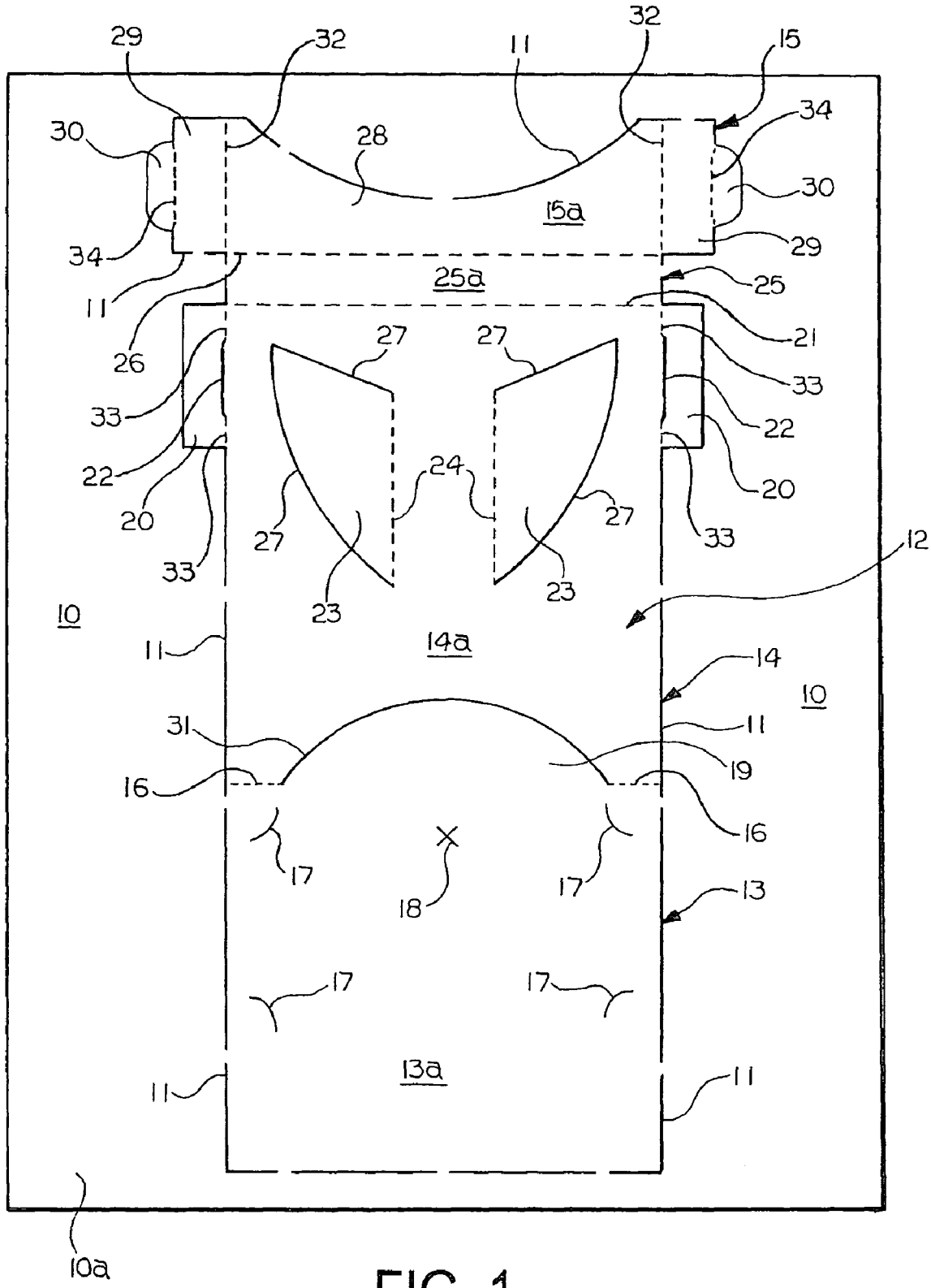
FIG. 1 is a schematic plan view of a blank for a printable die cut business card holder in accordance with the present invention.

As shown in FIG. 1, the blank 12 is aligned with the stock 10 in the "portrait" orientation well known to users of computer printers. Those skilled in the art, however, will appreciate that the blank 12 may be formed in a landscape orientation and/or oriented and/or sized to allow for multiple blanks 12 to be formed from a single sheet of stock.

The blank 12 is formed by a plurality of die cut and score lines. In FIG. 1, a line having relatively long solid portions interrupted by short breaks, such as a line 11, represents a die cut line with the solid portions being cuts extending through the stock 10 and the breaks being uncut stock that easily tears when the blank 12 is removed from the sheet. Dashed lines, such as lines 16, represent score lines that are continuous cuts that do not extend completely through the stock 10 and serve to facilitate folding of the blank 12 after the blank 12 has been removed from the stock 10, as discussed in more detail below. The line 11 is a cut line that defines a periphery of the blank 12 at which the blank can be separated from a surrounding carrier portion 10*a* of the sheet 10. During manufacture of the blank 12, the outer edge 11 is cut and formed by a die (not shown), which provides a complete cut through the sheet of stock 10 at the solid portions but allows the blank 12 to be run through the printer without separating from the sheet 10.

The blank 12 includes a front portion 13 at a lower end, a rear portion 14 in the middle, and a holder portion 15 at an upper end. The front portion 13 and the rear portion 14 are joined at opposed foldable side edges 16. The side edges 16 are scored such that the front portion 13 and the rear portion 14 are able to fold with respect to each other when the blank 12 is assembled, as outlined in more detail below. The front portion 13 includes four die cut curved slots 17 each for accepting a respective corner of a standard size business card 35, best seen in FIGS. 5 and 6. A generally X-shaped die cut slot 18 is formed intermediate the card holder slots 17 to facilitate inserting a push pin (not shown) or other type of fastener for mounting purposes, such as on a bulletin board or similar vertical planar surfaces. The front portion 13 includes a semicircular extension portion 19 intermediate the side edges 16 defining an upper edge of the front portion at a die cut line 31. However, the extension portion 19 can be of any desired shape.

The rear portion 14 includes a pair of wing portions 20 extending outwardly from sides of the rear portion 14 adjacent a score line lower edge 21 (after folding) thereof. An inner edge of each of the wing portions 20 includes a die cut line 22 formed in the stock 10 extending between a pair of score lines 33. The rear portion 14 also includes a pair of leg or support portions 23 formed therefrom. Each of the support portions 23 includes a vertically extending scored inner edge 24 and a die cut outer edge 27 and are operable to provide support when the card holder 12 is utilized as a free-standing member on a substantially horizontal surface, best seen in FIG. 4.

The rear portion 14 and the holder portion 15 are attached by a connector portion 25 that extends between the lower edge 21 of the rear portion 14 and a score line lower edge 26 (after folding) of the holder portion 15. The holder portion 15 of the blank 12 includes a front wall 28 and opposed outwardly extending side portions 29 attached at score lines 32. Each of the side portions 29 includes a tab 30 extending outwardly therefrom at score lines 34. The tabs 30 are inserted into corresponding slots formed at the die cut lines 22 of the wing portions 20 when the blank 12 is assembled. When assembled, as discussed in more detail below, the front portion 13, the connector portion 25, the front wall 28 and the side portions 29 form an open top holder pocket, indicated generally at 40 in FIG. 6, for a plurality of the business cards 35. Preferably, the holder pocket 40 is sized to receive standard-size business cards. Alternatively, the holder pocket 40 may be sized to receive any item suitable for display and disbursement such as brochures and CD-ROM's.

Figure 2:
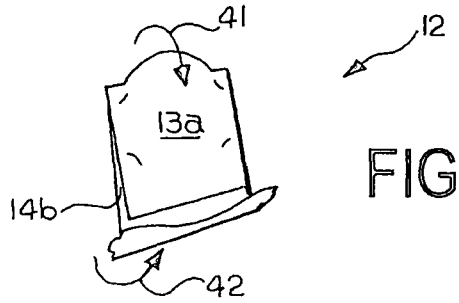
FIGS. 2 through 6 are perspective views of the business card holder of FIG. 1 shown in various stages of assembly.
Figure 3:
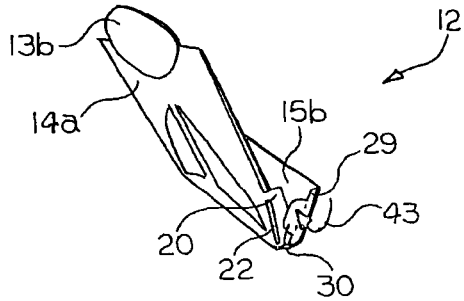
Figure 4:
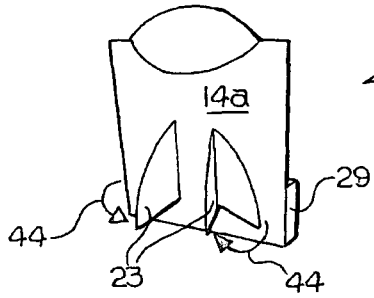

After the sheet 10 with the blank 12 has been run through the printer, the blank 12 may be separated from the carrier portion 10*a* of the sheet 10 to form a card holder best seen in FIGS. 2-7. Alternatively, the blank 12 may be separated from the sheet without running the sheet 10 and blank 12 through the printer. The blank 12 is separated from the sheet carrier portion 10*a* by applying pressure to the sheet 10 adjacent the cut lines on the outer edge 11 while holding on to the blank 12. Once the blank 12 is separated from the carrier portion 10*a*, the blank can be folded along the score lines, as shown in FIGS. 2-4, to form the holder.

Referring now to FIG. 1, the lines 11, 17, 18, 22, 27, and 31 represent die cut lines that extend through the sheet 10 and the lines 16, 21, 24, 26, 32, 33, and 34 represent score lines in the sheet 10, which do not extend completely through the sheet 10 and allow the respective portions 13, 14, and 15 to be folded to form the card holder.

The card holder 12 is assembled by folding the front portion 13 and the rear portion 14 along the score line 16 in a direction indicated by an arrow 41 (FIG. 2) such that an inner surface 13*b* (FIG. 3) of the front portion 13 and an inner surface 14*b* (FIG. 2) face toward each other and an outer surface 13*a* (FIG. 2) of the front portion 13 and an outer surface 14*a* (FIG. 3) of the rear portion 14 face away from each other.

After the front portion 13 and the rear portion 14 are folded, the connector portion 25 is folded towards the rear portion 14 along the score line 21 and the holder portion 15 is folded toward the connector portion 25 along the score line 26 in a direction indicated by an arrow 42 (FIG. 2) such that an inner surface 15*b* (FIG. 3) of the holder portion 15 faces toward the outer surface 13*a*. The wing portions 20 are folded along the score lines 33 such that they extend substantially perpendicular to a plane of the outer surface 14*a* (FIG. 3). The side portions are 29 are folded along the score lines 32 such that they extending substantially perpendicular to the inner surface 15*b* (FIG. 3) of the holder portion 15. The tabs 30 of the side portions 29 are folded along the score lines 34 such that they extend substantially perpendicular to the side portions 29 and are then inserted into the respective slots 22 in a direction indicated by an arrow 43 (FIG. 3) to enclose and form respective side walls of the holder pocket 40. When assembled, the holder pocket 40 is defined by the respective surfaces 13*a*, 15*b*, and the interior surfaces of the side portions 30, the wing portions 20 and the connector portion 25. The support portions 23 may be separated from the rear surface 14*a* along the cut lines 27 and folded outwardly along the score lines 24 in a direction indicated by an arrow 44 (FIG. 4) to extend substantially perpendicular to the surface 14*a*.

Figure 5:
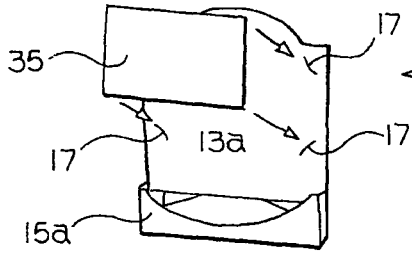
Figure 6:
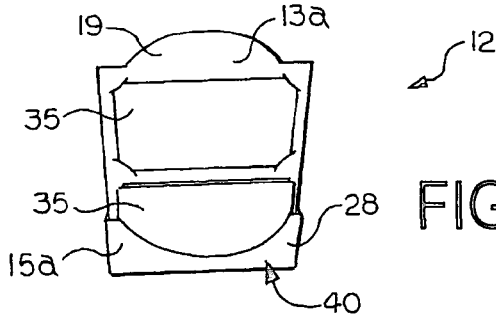

When thus assembled, the card holder 12 may advantageously be placed in a freestanding configuration on a horizontal planar surface, best seen in FIGS. 4-6. In the freestanding configuration, the card holder 12 rests on a lower surface 25*a* of the connector portion 25 and on the free lower edges of the extended support portions 23. If the support portions 23 are not extended outwardly from the rear surface 14*a*, the card holder 12 may be advantageously mounted to a substantially vertical surface such as a bulletin board (not shown) or the like. When mounted to the bulletin board, the support portions 23 are folded towards the rear surface 14*a* in a direction opposite the direction 44, which allows the rear surface 14*a* to be placed flush against the vertical surface of the bulletin board and held by a fastener (not shown) extending through the slot 18.

Figure 7:
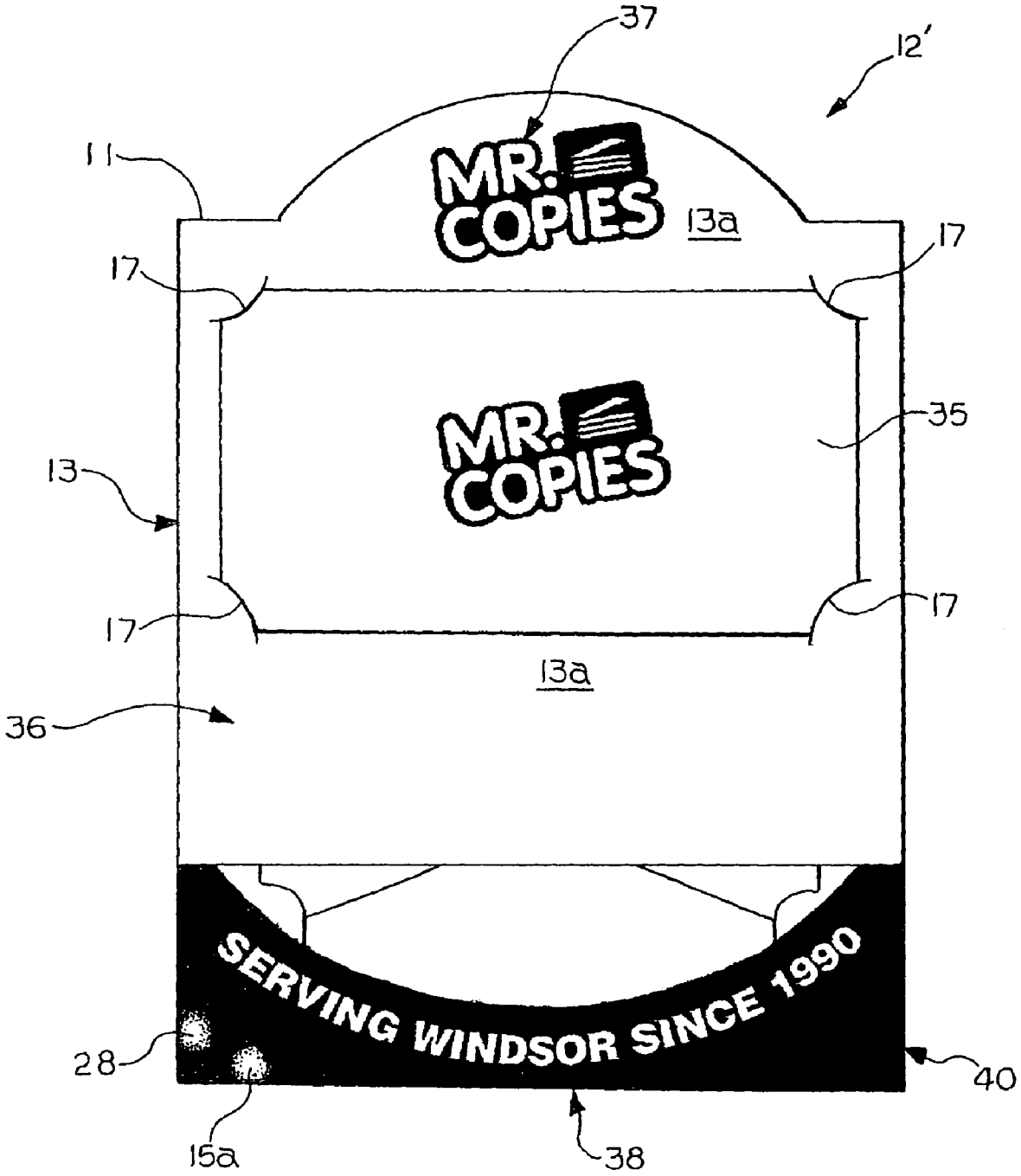
FIG. 7 is a front elevation view an alternate embodiment business card holder having printed surfaces according to the present invention.

As shown in FIG. 7, a printed holder 12' can have the surfaces 13*a* and 15*a* printed thereon with a design 36 and/or a logo 37 and/or a message 38. In fact, such printing can be advantageously performed on one or both sides of the blank 12 in any area. As described above, the printing is done while the blank 12 is attached to the carrier portion 10*a* of the sheet 10, which allows for an unlimited amount of creativity and customization on the part of the end user of the product. Printer templates and drivers may be written in software for controlling a printer of the card holder 12', similar to the numerous templates and drives for address labels, mailing labels and the like known in the art.

Advantageously, the support portions 23 may be folded inwardly or outwardly multiple times, so that the card holder 12, 12' may be moved from a vertically mounted position, to a horizontal surface free-standing configuration and back again as many times as desired, providing a great deal of flexibility in the presentation of the business cards. Alternatively, the card holder 12, 12' may be formed in any shape that is advantageous for presenting brochures, or other similar types of literature and other items.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A sheet of stock for forming an item holder comprising:

a planar carrier portion; and a planar blank portion detachably attached to said carrier portion by at least a first die cut line, said carrier portion and said blank portion being sized for printing on said blank portion by a printer, said blank portion including:

a front portion, a rear portion attached to said front portion at a first score line, a connector portion attached to said rear portion at a second score line, a holder portion attached to said connector portion at a third score line, whereby when said blank portion is detached from said carrier portion at said first die cut line, said front portion and said rear portion can be folded relative to each other along said first score line, said rear portion and said connector portion can be folded relative to each other along said second score line, and said connector portion and said holder portion can be folded relative to each other along said third score line to form an item holder having a holder pocket for receiving at least one item, said blank portion including a pair of support portions formed in said rear portion, each said support portion being partially separable from said rear portion at a second die cut line and being foldable relative to said rear portion along a fourth score line, a pair of wing portions extending from said rear portion, said wing portions being foldable relative to said rear portion to form side walls of said holder pocket, a pair of side portions extending from said holder portion, said side portions being foldable relative to said holder portion to cooperate with said wing portions to form said side walls of said holder pocket, and a pair of tabs extending from said side portions, said tabs being foldable relative to said side portion, and a pair of slots formed at said wing portions for retaining said tabs.

2. The sheet of stock according to claim 1 wherein said sheet of stock is formed from a paper suitable for receiving and retaining printing applied by a printer.

3. The sheet of stock according to claim 1 wherein said holder pocket is sized to receive a plurality of business cards.

4. An item holder comprising:

a planar front portion;

a planar rear portion attached to said front portion at a first score line;

a pair of support portions formed in said rear portion, each said support portion being partially separable from said rear portion and being foldable relative to said rear portion;

a planar connector portion attached to said rear portion at a second score line;

a planar holder portion attached to said connector portion at a third score line;

a pair of wing portions extending from said rear portion;

a pair of side portions extending from said holder portion; and a pair of tabs extending from said side portions and a pair of slots formed at said wing portions and retaining said tabs, said front portion, said connector portion, said holder portion, said wing portions and said side portions being folded relative to each other to form a holder pocket for receiving at least one item.

5. The item holder according to claim 4 wherein said item holder is formed from a paper suitable for receiving and retaining printing applied by a printer.

6. The item holder according to claim 4 wherein said holder pocket is sized to receive a plurality of business cards.

7. The item holder according to claim 4 including a die cut line interrupting said first score line, said die cut line forming an edge of an extension portion extending upwardly from said front portion.

8. A business card holder comprising:

a planar front portion having a plurality of business card receiving slots formed therein;

a planar rear portion attached to said front portion at a first score line;

a planar connector portion attached to said rear portion at a second score line;

a planar holder portion attached to said connector portion at a third score line;

a pair of wing portions each extending from said rear portion at a fourth score line; and a pair of side portions each extending from said holder portion at a fifth score line, said front portion, said connector portion, said holder portion, said wing portions and said side portions being folded relative to each other at said first through fifth score lines to form a holder pocket for receiving at least one business cards, including a pair of tabs extending from said side portions and a pair of slots formed at said wing portions and retaining said tabs.

9. The business card holder according to claim 8 wherein said business card holder is formed from a paper suitable for receiving and retaining printing applied by a printer.

10. The business card holder according to claim 8 including a pair of support portions formed in said rear portion, each said support portion being partially separable from said rear portion at a die cut line and being foldable relative to said rear portion at a sixth score line.

11. The business card holder according to claim 8 including a die cut line interrupting said first score line, said die cut line forming an edge of an extension portion extending upwardly from said front portion.

12. The business card holder according to claim 8 including a die cut slot formed in said front portion for receiving a fastener.

13. A sheet of stock for forming an item holder comprising:

a planar carrier portion; and a planar blank portion detachably attached to said carrier portion by at least a first die cut line, said carrier portion and said blank portion being sized for printing on said blank portion by a printer, said blank portion including:

a front portion, a rear portion attached to said front portion at a first score line, a connector portion attached to said rear portion at a second score line, a holder portion attached to said connector portion at a third score line, whereby when said blank portion is detached from said carrier portion at said first die cut line, said front portion and said rear portion can be folded relative to each other along said first score line, said rear portion and said connector portion can be folded relative to each other along said second score line, and said connector portion and said holder portion can be folded relative to each other along said third score line to form an item holder having a holder pocket for receiving at least one item, said blank portion including a pair of support portions formed in said rear portion, each said support portion being partially separable from said rear portion at a second die cut line and being foldable relative to said rear portion along a fourth score line, a pair of wing portions extending from said rear portion, said wing portions being foldable relative to said rear portion to form side walls of said holder pocket, and a pair of side portions extending from said holder portion, said side portions being foldable relative to said holder portion to cooperate with said wing portions to form said side walls of said holder pocket, wherein said first score line is interrupted by a second die cut line extending into said rear portion whereby when said front and rear portions are folded along said first score line, said front portion separates from said rear portion along said second die cut line to form an upstanding extension portion.

14. The sheet of stock according to claim 13 wherein said sheet of stock is formed from a paper suitable for receiving and retaining printing applied by a printer.

15. The sheet of stock according to claim 13 wherein said holder pocket is sized to receive a plurality of business cards.

* * * * *